US010968691B2

(12) United States Patent
Przydzial

(10) Patent No.: US 10,968,691 B2
(45) Date of Patent: Apr. 6, 2021

(54) PADDED BOTTOM AND SECURITY EDGE FOR BREAKAWAY DOOR

(71) Applicant: Performax Global, Aston, PA (US)

(72) Inventor: Grzegorz Przydzial, Sedziszow Mlp. (PL)

(73) Assignee: Performax Global, Aston, PA (US)

( * ) Notice: Subject to any disclaimer, the term of this patent is extended or adjusted under 35 U.S.C. 154(b) by 207 days.

(21) Appl. No.: 15/996,315

(22) Filed: Jun. 1, 2018

(65) Prior Publication Data

US 2018/0363365 A1 Dec. 20, 2018

Related U.S. Application Data

(60) Provisional application No. 62/514,648, filed on Jun. 2, 2017.

(51) Int. Cl.
*E06B 9/17* (2006.01)
*E06B 9/06* (2006.01)
*E06B 9/58* (2006.01)

(52) U.S. Cl.
CPC ..... *E06B 9/17046* (2013.01); *E06B 9/0692* (2013.01); *E06B 9/17076* (2013.01); *E06B 9/581* (2013.01)

(58) Field of Classification Search
CPC ..... E06B 9/17046; E06B 9/0692; E06B 9/17076; E06B 9/581; E06B 9/388; E06B 2009/002; E06B 9/582
USPC ..... 160/267.1, 273.1, 349.1; 52/173.2
See application file for complete search history.

(56) References Cited

U.S. PATENT DOCUMENTS 3,665,997 A * 5/1972 Smith ..... B65G 69/008 52/173.2
5,758,705 A * 6/1998 Wagner ..... E06B 9/13 160/265
5,765,622 A * 6/1998 Lichy ..... E06B 9/13 160/201
2007/0169896 A1* 7/2007 Snyder ..... E06B 9/17046 160/133
2008/0104902 A1* 5/2008 Ashelin ..... B65G 69/008 52/173.2
2011/0083815 A1* 4/2011 Kriner ..... E06B 3/80 160/127
2013/0068400 A1* 3/2013 Dwarka ..... E06B 9/58 160/120
2016/0376841 A1* 12/2016 Hentschel ..... E06B 9/581 160/270

* cited by examiner

*Primary Examiner* — Patrick J Maestri
(74) *Attorney, Agent, or Firm* — Dunlap Codding, P.C.

(57) ABSTRACT

The present invention is a breakaway door with a padded bottom bar to protect vehicles that collide with said breakaway door. The padded bottom bar is mounted adjacent the bottom of the breakaway door. It includes a padded bottom bar having a bumper, a first tab extending from the bumper, and a mounting plate. The mounting plate is fixed to the bottom of the door with the first tab sandwiched between the plate and the door to mount the bumper to the door. A bottom loop suspends from the bottom of the breakaway door. The bottom loop has a cushion and a second tab sandwiched between the plate and the breakaway door to mount the bottom loop too the breakaway door. The bottom loop provides additional sealing and security to the breakaway door.

22 Claims, 6 Drawing Sheets

FIG. 2A
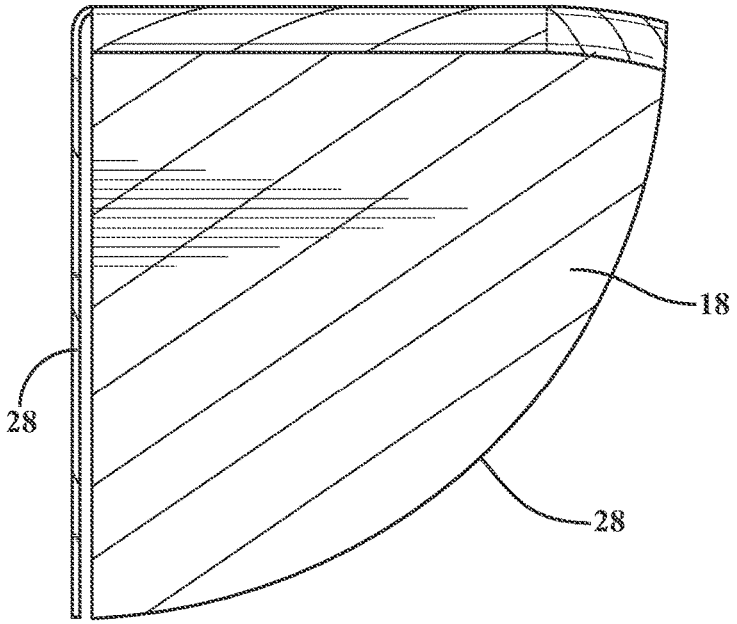
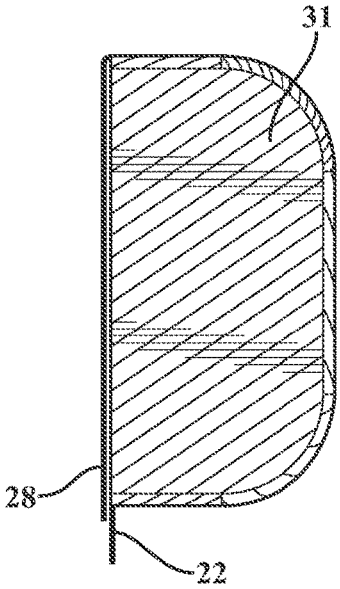
FIG. 2B
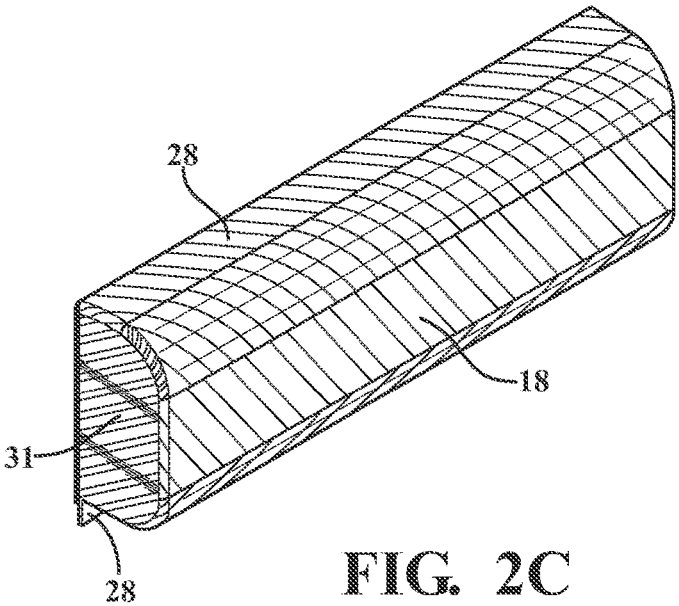
FIG. 2C

FIG. 3A
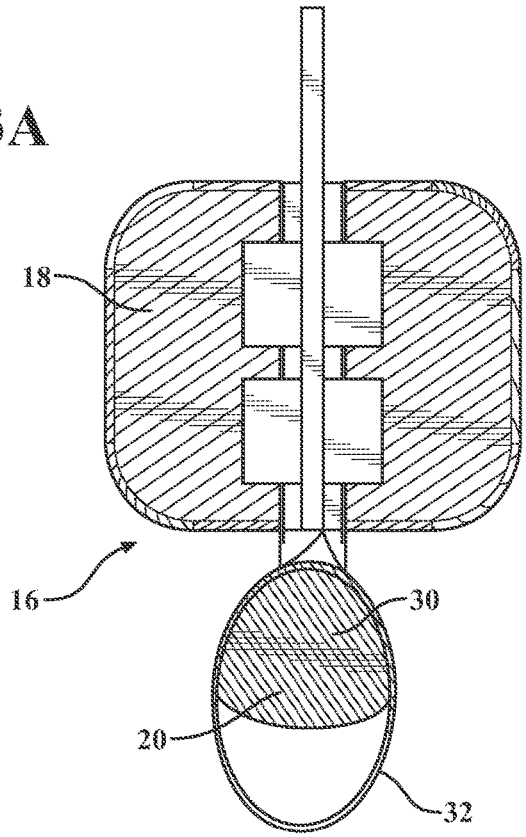
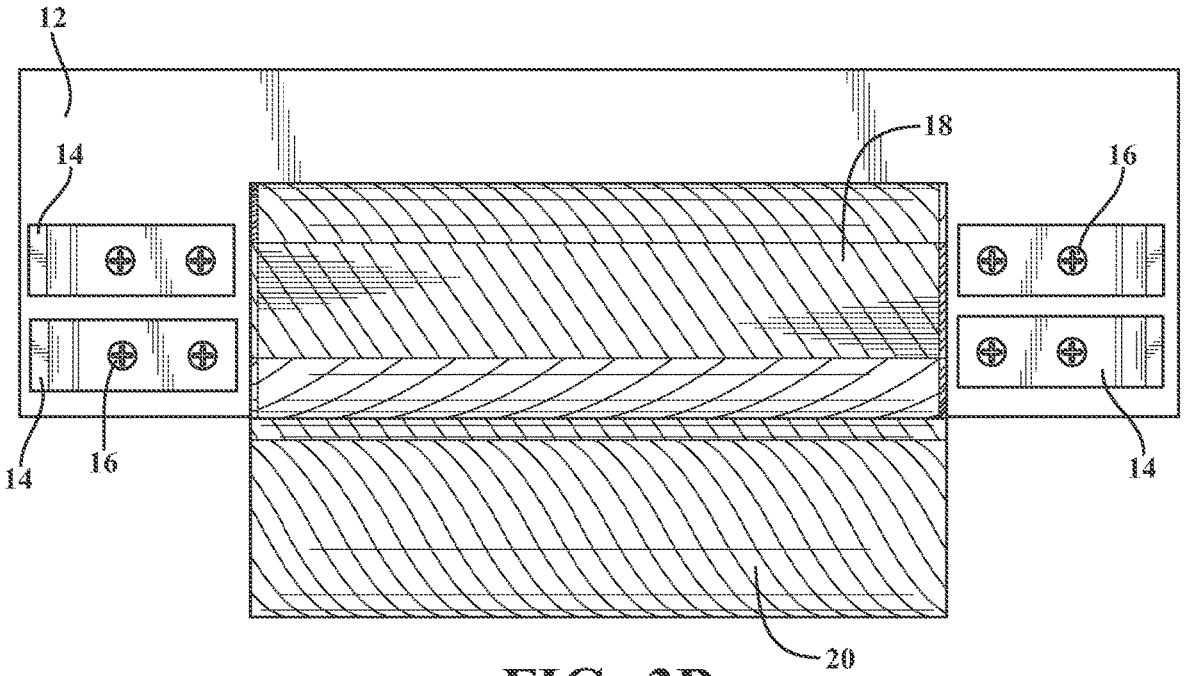
FIG. 3B

PADDED BOTTOM AND SECURITY EDGE FOR BREAKAWAY DOOR

RELATED APPLICATIONS

This application claims the benefit of U.S. Provisional Application No. 62/514,648 filed on Jun. 2, 2017, which is incorporated herein by reference.

STATEMENT REGARDING FEDERALLY SPONSORED RESEARCH

NONE.

TECHNICAL FIELD

This invention relates generally to breakaway doors.

BACKGROUND OF THE INVENTION

Commercial buildings commonly use roll up doors to open and close large entryways, such as loading bays. Roll up doors can be made of various materials, aluminum, steel, vinyl and rubber are common materials. Roll up flexible doors are typically made of vinyl or rubber. A rotating shaft allows the material to be rolled onto and unrolled from the shaft. Some of these doors include tracks mounted on the sides of the opening to guide and hold the flexible material in place.

Some flexible doors are breakaway doors. Breakaway doors release from the guide tracks when impacted by for example a vehicle. This reduces or eliminates damage to the door and the building. These doors can be quickly reset with a minimum of effort.

The problem with breakaway doors is that they have a metal plate at the bottom to weigh down the door and assist in closing. This metal plate flies into the air when the door is impacted and crashes into the vehicle. This can cause damage to the vehicle. A breakaway door is needed that will not damage a vehicle in the event of impact with the door.

SUMMARY OF THE INVENTION

The present invention is a breakaway door with a padded bottom bar to protect vehicles that collide with the breakaway door. The padded bottom bar is mounted adjacent the bottom of the breakaway door. It includes a padded bottom bar having a bumper, a first tab extending from the bumper, and a mounting plate. The mounting plate is fixed to the bottom of the door with the first tab sandwiched between the plate and the door to mount the bumper to the door. A bottom loop suspends from the bottom of the breakaway door. The bottom loop has a cushion and a second tab sandwiched between the plate and the breakaway door to mount the bottom loop too the breakaway door. The bottom loop provides additional sealing and security to the breakaway door.

These and other features and advantages of this invention will become more apparent to those skilled in the art from the detailed description of a preferred embodiment. Described below are the drawings that accompany the detailed description.

BRIEF DESCRIPTION OF THE DRAWINGS

FIG. 2A is a detailed view of the padded cushion for breakaway doors of the present invention taken from FIG. 1.

FIG. 2B is an end view of the padded cushion of FIG. 2A illustrating the interrelationship of the padded cushion, first tab, and plate.

FIG. 2C is a perspective view of FIG. 2B.

FIG. 3A is an end view of the padded bottom and security edge for breakaway doors of the present invention.

FIG. 3B is a side view of the padded bottom and security edge for breakaway doors of the present invention.

DETAILED DESCRIPTION OF A PREFERRED EMBODIMENT

Figure 1:
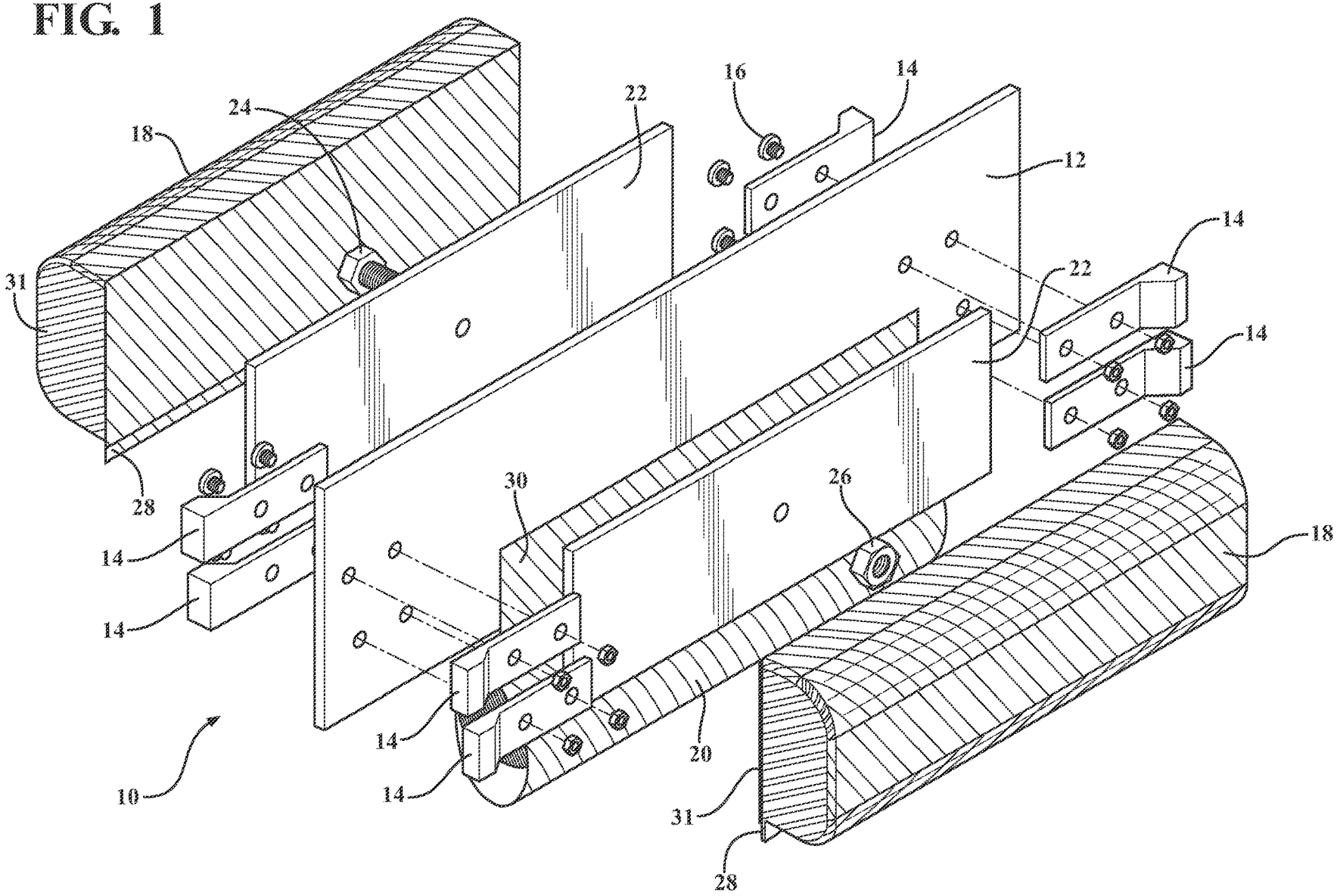
FIG. 1 is an exploded view of the padded bottom and security edge for breakaway doors of the present invention.
Figure 3C:
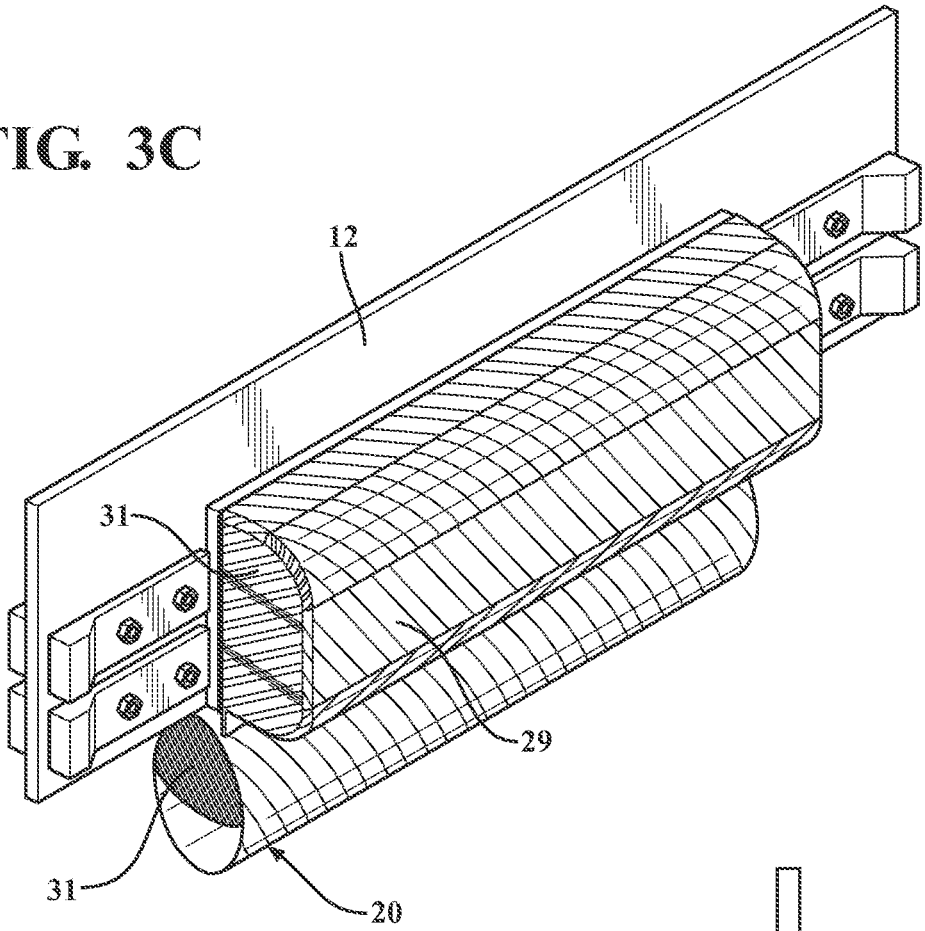
FIG. 3C is a perspective view of the padded bottom and security edge for breakaway doors of the present invention.
Figure 4A:
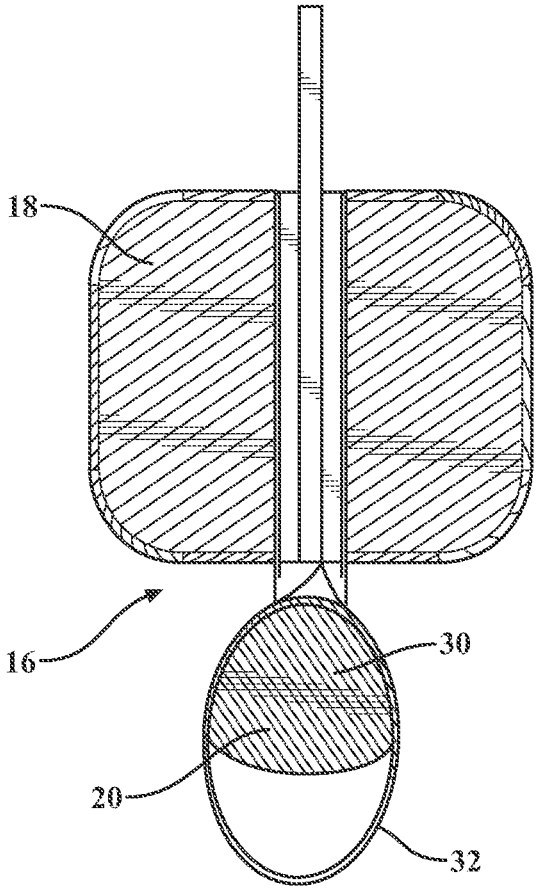
FIG. 4A is a cross sectional view taken along line A-A of FIG. 3C.
Figure 4B:
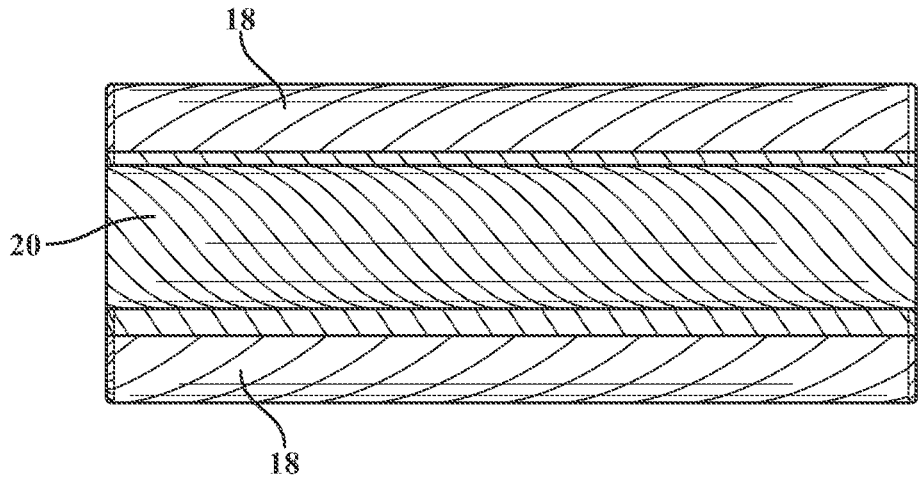
FIG. 4B is a bottom view of the padded bottom and security edge for breakaway doors of the present invention.
Figure 4C:
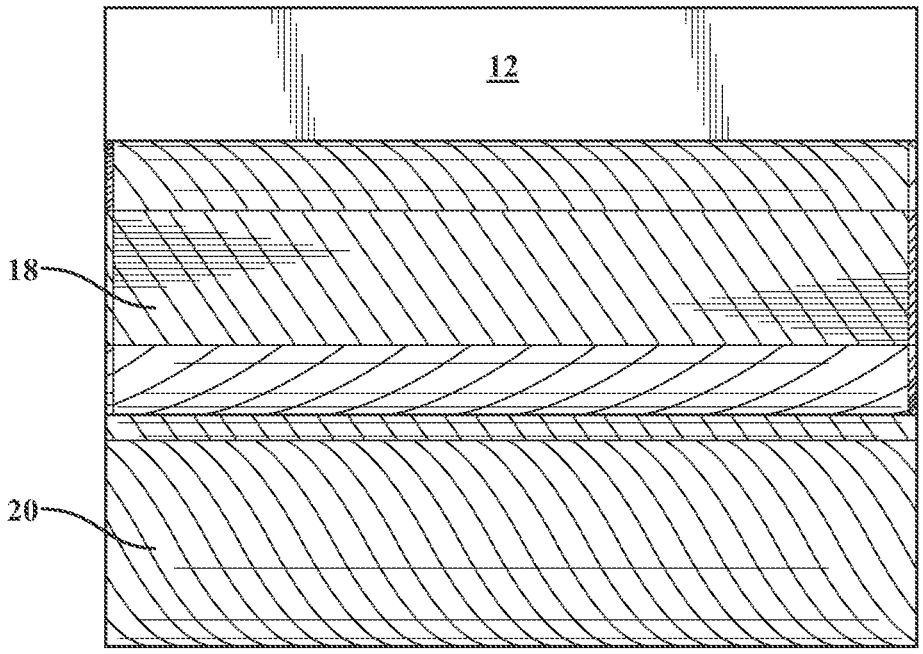
FIG. 4C is a side view of the padded bottom and security edge for breakaway doors of the present invention.
Figure 4D:
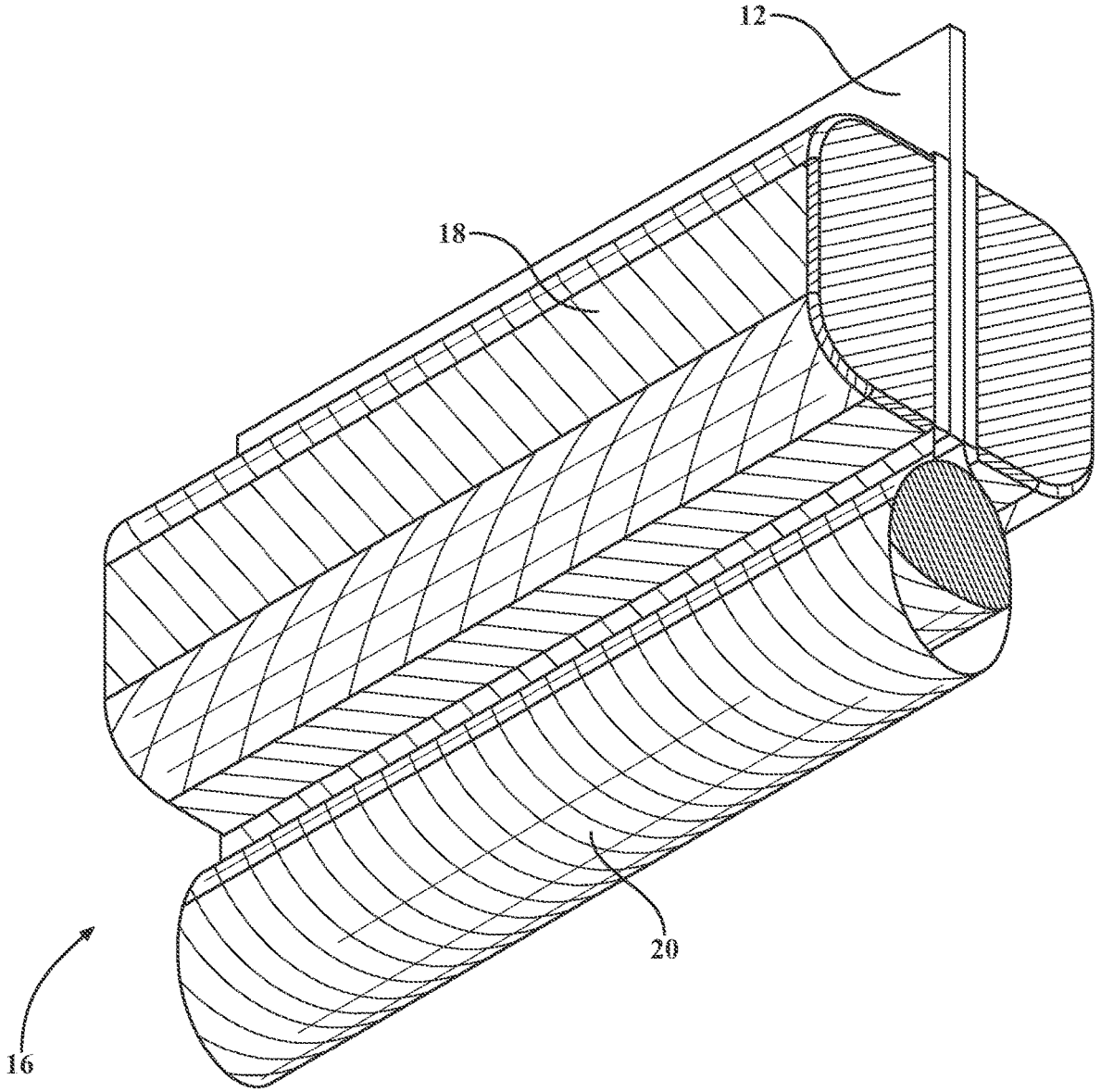
FIG. 4D is a bottom perspective view of the padded bottom and security edge for breakaway doors of the present invention.

With reference to the various FIGS. 1 thru 4, the padded bottom bar and security edge of the present invention is illustrated generally at 10. Those of ordinary skill in the art will appreciate that this is a partial representation of the door 12. The door 12 would be taller and wider to span the opening of a building. The padded bottom and security edge 10 of the present invention would typically extend along the entire bottom edge of the breakaway door 12. In the alternative, the padded bottom and security edge 10 of the present invention could be several sections spaced along the width of the door 12.

Typically, industrial facilities use breakaway doors 12 to close the door opening to a loading dock etc. The doors 12 are typically roll up rubber doors. The rubber doors are resistant to improper entry due to their size and the thickness of the rubber used to make the rubber door. The padded bottom bar and security edge 10 is typically used on breakaway rubber doors. Breakaway doors have side locks that are received in tracks and allow the door to be released from the tracks upon inadvertent impact. In this way, damage to the door, tracks and building are reduced or even eliminated. In most situations, the locks can be reinserted into the tracks after impact so that the door can continue to be used after.

In the disclosed embodiment, the breakaway rubber door 12 includes locks 14. Bolts and nuts 16 fasten the locks 14 to the edges of the rubber door 12. Other attachment methods could be used, such as screws, rivets, adhesives, etc. Tracks mounted on the sides of the door opening receive the locks 14 to release the door from the tracks upon inadvertent impact. The padded bottom and security edge 10 reduces or prevents damage to vehicles that may inadvertently collide with the rubber door 12. The padded bottom and security edge 10 is made of relatively soft material and will reduce or eliminate damage to a vehicle upon impact.

Typically, a metal bar is provided along the bottom of the rubber door 12 and upon inadvertent collision, the vehicle can be damaged because of impact with the metal bottom bar. The present padded bottom bar and security edge 10 of the present invention provides a bottom bar that reduces or eliminates damage to a vehicle.

The padded bottom bar and security edge 10 of the present invention includes front and back padded cushions 18 which are mounted through a plate 22 to the bottom edge of the rubber door 12. The security edge 20 is mounted to the bottom edge of the rubber door 12. In the disclosed embodiment, a plate 22 is mounted through bolts 24 and 26 to the bottom of the rubber door 12. As will be appreciated, there are a number of bolts 24 and 26 located along the elongated plate 22, which extends across the bottom of the rubber door 12. In the alternative, the padded bottom bar and security edge 10 could be made in smaller sections and mounted along the bottom of the rubber door 12.

In the disclosed embodiment, the cushions 18 have an exterior covering 29 with a first tab or flap 28. The tab or flap 28 in the disclosed embodiment is an extension of the exterior covering 29. The tab or flap 28 is received behind plates 22 to secure the pad 18 to the bottom edge of the rubber door 12. The security edge 20 includes a second tab 30 or flap that is also mounted between the plates 22 to secure the security edge 20 to the bottom edge of the door 12.

The security edge includes an internal cushion or pad, such as rubber 31 and an external material 32. The padded bottom bars 18 also include an external material 29 and a rubber internal material 31. In the disclosed embodiment, the exterior material 29 and 32 is vinyl.

In the disclosed embodiment, the door 12 has padded bottom bars 18 on the front and back of the door. It should be appreciated by those of ordinary skill in the art that door 12 could have a single pad 18 on one side of the door 12 if desired.

As will be appreciated by those of ordinary skill in the art the present invention is a simple, inexpensive and easy to install padded bottom bar and security edge 10 to reduce and even prevent damage to vehicles upon impact of the rubber door 12 by for example a vehicle. Additionally, the security edge 20 provides a seal for the door to prevent the ingress of air underneath the door and securely closes the bottom of the door.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

I claim:

1. A breakaway door having a top, opposed sides and a bottom, said breakaway door comprising:

a padded bottom bar, said padded bottom bar is mounted adjacent said bottom of said breakaway door, said padded bottom bar includes a bumper, a first tab extending from said bumper, and a mounting plate, said mounting plate being fixed to said bottom of said breakaway door, said first tab being sandwiched between said plate and said breakaway door to mount said bumper to said breakaway door;

a bottom loop suspended from said bottom of said breakaway door, said bottom loop having a cushion and a second tab sandwiched between said plate and said breakaway door to mount said bottom loop to said breakaway door;

whereby said padded bottom bar provides protection to vehicles colliding with said breakaway door, said bottom loop providing additional sealing to said breakaway door.

2. The breakaway door of claim 1, wherein said bumper includes an exterior material cover, said first tab is an extension of said material cover.

3. The breakaway door of claim 1, wherein said padded bottom bar extends between said opposed sides.

4. The breakaway door of claim 1, wherein said breakaway door has a front face and a rear face, said padded bottom bar has two bumpers, each of said bumpers having a first tab extending from each said bumpers, and two plates, one of said bumpers and plate being mounted to said front face with said tab sandwiched between said plate and said front face and the other of said bumper and plates being mounted to said rear face with said tab sandwiched between said plate and said rear face.

5. The breakaway door of claim 4, wherein at least one bumper includes an exterior material cover, said first tab is an extension of said material cover.

6. The breakaway door of claim 4, wherein said padded bottom bar extends between said opposed sides.

7. The breakaway door of claim 1, further including a fastener for fixing said mounting plate to said bottom of said breakaway door.

8. The breakaway door of claim 7, wherein said fastener is a bolt extending through said plate and said breakaway door and a nut mounted to said bolt.

9. The breakaway door of claim 4, further including a fastener for fixing said mounting plates to said bottom of said breakaway door.

10. The breakaway door of claim 9, wherein said fastener is a bolt extending through said plates and said breakaway door and a nut mounted to said bolt.

11. The breakaway door of claim 1, further including locks for releasably mounting said breakaway door to a guide track.

12. The breakaway door of claim 1, wherein said breakaway door is made of rubber.

13. A padded bottom bar for use on a breakaway door said padded bottom bar comprising:

a bumper, a first tab extending from said bumper, and a mounting plate said mounting plate being adapted to be fixed to said breakaway door, said first tab being sandwiched between said plate and said breakaway door to mount said bumper to said breakaway door;

a bottom loop adapted to be suspended from the breakaway door, said bottom loop having a cushion and a second tab adapted to be sandwiched between said plate and the breakaway door to mount said bottom loop to the breakaway door;

whereby said padded bottom bar provides protection to vehicles colliding with the breakaway door, said bottom loop providing additional sealing to said breakaway door.

14. The breakaway door of claim 13, wherein said bumper includes an exterior material cover, said first tab is an extension of said material cover.

15. The breakaway door of claim 13, further including a fastener for fixing said mounting plate to the bottom of the breakaway door.

16. The breakaway door of claim 15, wherein said fastener is a bolt for extending through said plate and the breakaway door and a nut mounted to said bolt.

17. A breakaway rubber door having a top, opposed sides, a bottom, a front face and a rear face, said breakaway rubber door comprising:

a padded bottom bar, said padded bottom bar mounted adjacent said bottom of said breakaway rubber door, said padded bottom bar including a bumper, a first tab extending from said bumper, and a mounting plate, said mounting plate being fixed to said bottom of said breakaway rubber door, said first tab being sandwiched between said plate and said breakaway rubber door to mount said bumper to said breakaway rubber door;

whereby said padded bottom bar provides protection to vehicles colliding with said breakaway rubber door.

18. The breakaway door of claim 17, further including a bottom loop suspended from the said bottom of said breakaway rubber door, said bottom loop having a cushion and a second tab sandwiched between said plate and said breakaway rubber door to mount said bottom loop to said breakaway rubber door, said bottom loop providing additional sealing to said breakaway rubber door.

19. The breakaway door of claim 17, wherein said that bumper includes an exterior material cover, said first tab is an extension of said material cover.

20. The breakaway door of claim 17, wherein said padded bottom bar extends between said opposed sides.

21. The breakaway door of claim 17, wherein said padded bottom bar has two bumpers, each of said bumpers having a first tab extending from each said bumpers, and two plates, one of said bumpers and plate being mounted to said front face with said tab sandwiched between said plate and said front face and the other of said bumper and plates being mounted to said rear face with said tab sandwiched between said plate and said rear face.

22. The breakaway door of claim 17, further including a fastener for fixing said mounting plate to said bottom of said breakaway door.

* * * * *